US006394150B1

(12) United States Patent
Haimovich et al.

(10) Patent No.: US 6,394,150 B1
(45) Date of Patent: May 28, 2002

(54) COMPUTERIZED FLUID SUPPLY SYSTEMS

(75) Inventors: Yosef Haimovich, Rishon le Zion; Roni Cohen, Zoran, both of (IL)

(73) Assignee: Hi-G-Tek Ltd. (IL)

( * ) Notice: Subject to any disclaimer, the term of this patent is extended or adjusted under 35 U.S.C. 154(b) by 0 days.

(21) Appl. No.: 09/710,739

(22) Filed: Nov. 10, 2000

(30) Foreign Application Priority Data

Nov. 10, 1999 (IL) ..... 132858

(51) Int. Cl.[7] ..... B65B 1/30
(52) U.S. Cl. ..... 141/94; 141/98; 340/825.72
(58) Field of Search ..... 141/94, 98, 231; 340/5.9, 825.72

(56) References Cited

U.S. PATENT DOCUMENTS

| | | | | |
|---|---|---|---|---|
| 3,814,148 | A | | 6/1974 | Wostl |
| 4,263,945 | A | | 4/1981 | Van Ness |
| 4,469,149 | A | | 9/1984 | Walkey et al. |
| 4,846,233 | A | | 7/1989 | Fockens |
| 4,934,419 | A | | 6/1990 | Lamont et al. |
| 5,156,198 | A | | 10/1992 | Hall |
| 5,204,819 | A | | 4/1993 | Ryan |
| 5,244,017 | A | | 9/1993 | Hartman et al. |
| 5,249,612 | A | | 10/1993 | Parks et al. |
| 5,316,057 | A | | 5/1994 | Hasselmann |
| 5,359,522 | A | | 10/1994 | Ryan |
| 5,605,182 | A | | 2/1997 | Oberrecht et al. |
| 5,722,469 | A | | 3/1998 | Tuminaro |
| 5,727,608 | A | | 3/1998 | Nusbaumer et al. |
| 5,857,501 | A | | 1/1999 | Kelerich et al. |
| 5,890,520 | A | | 4/1999 | Johnson, Jr. |
| 5,923,572 | A | | 7/1999 | Pollock |
| 6,116,298 | A | * | 9/2000 | Haimovich et al. ..... 141/94 |

* cited by examiner

*Primary Examiner*—Timothy L. Maust
(74) *Attorney, Agent, or Firm*—Blakely, Sokoloff, Taylor & Zafman

(57) ABSTRACT

A computerized fluid supply system including a controller controlling at least supply of a fluid via a fluid fill nozzle to a tank, a fluid tank mounted identifier, a fluid fill nozzle mounted tank identification reader assembly, the fluid fill nozzle reader being in wireless communication with the tank identifier for receiving tank identification information therefrom and with the system controller, the fluid fill nozzle mounted tank identification reader assembly including a conduit portion connected in series with the nozzle and electronic circuitry mounted exteriorly of the conduit portion.

48 Claims, 16 Drawing Sheets

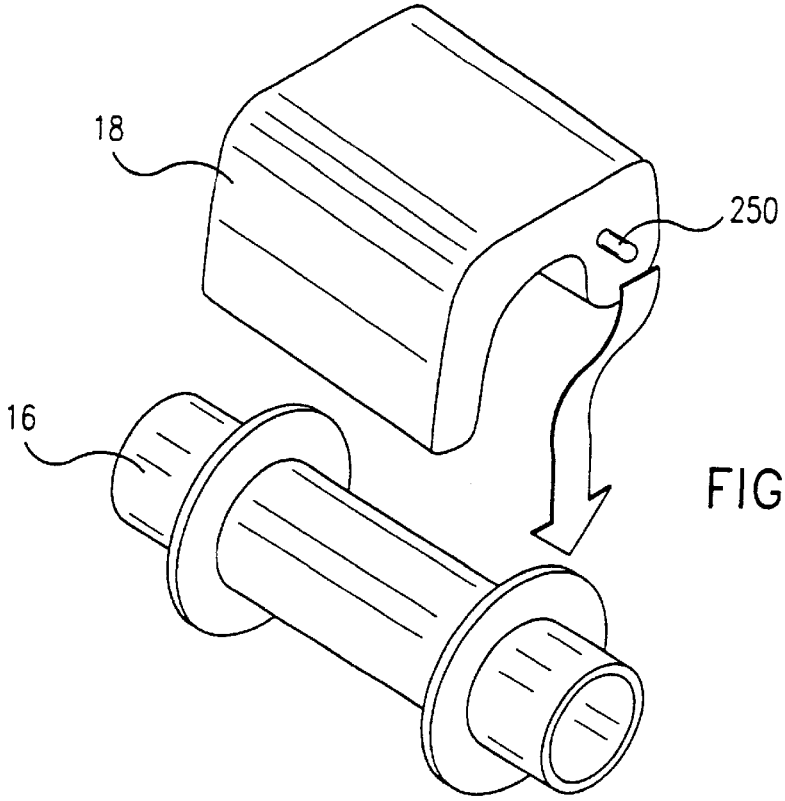
FIG. 5A
FIG. 5B
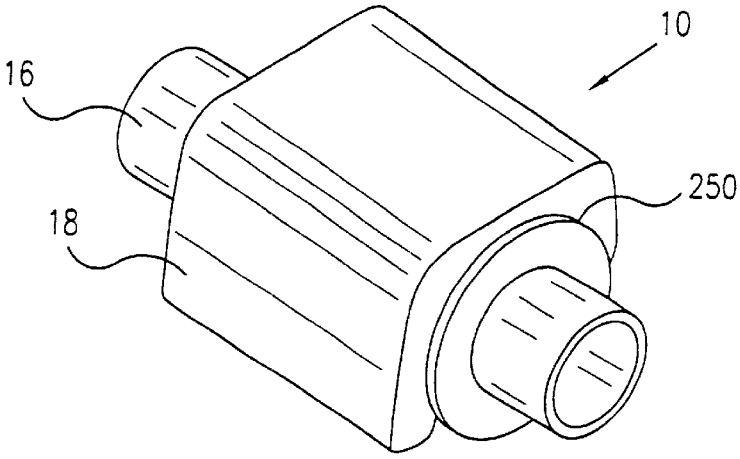

COMPUTERIZED FLUID SUPPLY SYSTEMS

FIELD OF THE INVENTION

The present invention relates to computerized fluid supply systems generally as well as to components thereof.

BACKGROUND OF THE INVENTION

Various types of computerized fluid supply systems are known in the patent literature. The flowing U.S. Patents, found on search, are believed to represent the state of the art: U.S. Pat. Nos. 5,923,572; 5,890,520; 5,857,501; 5,727,608; 5,722,469; 5,249,612; 5,244,017; 5,156,198; 5,605,182; 5,359,522; 5,316,057; 5,204,819; 4,934,419; 4,846,233; 4,469,149; 4,263,945; 3,814,148.

SUMMARY OF THE INVENTION

The present invention seeks to provide an improved computerized fluid supply system.

There is thus provided in accordance with a preferred embodiment of the present invention a computerized fluid supply system including a controller controlling at least supply of a fluid via a fluid fill nozzle to a tank, a fluid tank mounted identifier, a fluid fill nozzle mounted tank identification reader assembly, the fluid fill nozzle reader being in wireless communication with the tank identifier for receiving tank identification information therefrom and with the system controller, the fluid fill nozzle mounted tank identification reader assembly including a conduit portion connected in series with the nozzle and electronic circuitry mounted exteriorly of the conduit portion.

Further in accordance with a preferred embodiment of the present invention the conduit portion is removably connected in series with the nozzle. Preferably the conduit portion is threadably connected in series with the nozzle.

Additionally in accordance with a preferred embodiment of the present invention the electronic circuitry is removably mounted onto the conduit portion. Furthermore, the electronic circuitry includes at least one battery which is removably mounted onto the conduit portion. Preferably the electronic circuitry is removably mounted onto the conduit portion and includes a switch which prevents electrical arcing upon mounting or removal of the at least one battery.

Still further in accordance with a preferred embodiment of the present invention the electronic circuitry is removably mounted onto the conduit portion and includes a switch which prevents electrical arcing upon mounting or removal of the electronic circuitry from the conduit portion.

Further in accordance with a preferred embodiment of the present invention the electronic circuitry is powered by electrical energy stored in an electrical energy storage device associated therewith. Preferably the electrical energy storage device receives electrical energy from an external electrical energy source.

Additionally in accordance with a preferred embodiment of the present invention the external electrical energy source is associated with the tank identifier.

Additionally or alternatively the external electrical energy source is associated with the controller.

Furthermore the external electrical energy source is associated with a storage location at which the nozzle is located when not engaged in fluid supply.

Moreover in accordance with a preferred embodiment of the present invention the electrical energy storage device receives electrical energy from an external electrical energy source in a wireless manner.

Still further in accordance with a preferred embodiment of the present invention the electrical circuitry is operative in a quiescent mode and in an active mode and wherein the electric circuitry shifts from the quiescent mode to the active mode in response to the orientation of the nozzle.

Additionally in accordance with a preferred embodiment of the present invention the electrical circuitry is coupled to at least one external antenna which is mounted on the nozzle at a location forward of the conduit portion. Preferably the electrical circuitry is coupled to the at least one external antenna in a wireless manner.

There is also provided in accordance with a preferred embodiment of the present invention, a device for use in a computerized fluid supply system including a controller controlling at least supply of fluid via a fluid fill nozzle to a fluid receiving tank and a tank identifier, a fluid fill nozzle mounted tank identification reader assembly, the fluid fill nozzle reader being in wireless communication with the tank identifier for receiving tank identification information therefrom and with the system controller, the fluid fill nozzle mounted tank identification reader assembly including a conduit portion connected in series with the nozzle and electronic circuitry mounted exteriorly of the conduit portion.

Further in accordance with a preferred embodiment of the present invention the conduit portion is removably connected in series with the nozzle. Preferably the conduit portion is threadably connected in series with the nozzle.

Still further in accordance with a preferred embodiment of the present invention the electronic circuitry is removably mounted onto the conduit portion.

Additionally in accordance with a preferred embodiment of the present invention the electronic circuitry includes at least one battery which is removably mounted onto the conduit portion.

Additionally in accordance with a preferred embodiment of the present invention the electronic circuitry is removably mounted onto the conduit portion and includes a switch which prevents electrical arcing upon mounting or removal of the electronic circuitry from the conduit portion. Preferably the electronic circuitry is removably mounted onto the conduit portion and includes a switch which prevents electrical arcing upon mounting or removal of the at least one battery.

Moreover in accordance with a preferred embodiment of the present invention the electronic circuitry is powered by electrical energy stored in an electrical energy storage device associated therewith. Preferably the electrical energy storage device receives electrical energy from an external electrical energy source.

Further in accordance with a preferred embodiment of the present invention the external electrical energy source is associated with the tank identifier.

Additionally or alternatively the external electrical energy source is associated with the controller.

Furthermore in accordance with a preferred embodiment of the present invention the external electrical energy source is associated with a storage location at which the nozzle is located when not engaged in fluid supply.

Preferably the electrical energy storage device receives electrical energy from an external electrical energy source in a wireless manner.

Additionally in accordance with a preferred embodiment of the present invention the electrical circuitry is operative in a quiescent mode and in an active mode and wherein the electric circuitry shifts from the quiescent mode to the active mode in response to the orientation of the nozzle.

Still further in accordance with a preferred embodiment of the present invention the electrical circuitry is coupled to at least one external antenna which is mounted on the nozzle at a location forward of the conduit portion. Preferably the electrical circuitry is coupled to the at least one external antenna in a wireless manner.

There is further provided in accordance with yet another preferred embodiment of the present invention, a device for use in a computerized fluid supply system including a controller controlling at least supply of fluid via a fluid fill nozzle to a fluid receiving tank and a tank identifier, a fluid fill nozzle assembly including a fluid fill is nozzle mounted tank identification reader assembly, the fluid fill nozzle reader being in wireless communication with the tank identifier for receiving tank identification information therefrom and with the system controller, the fluid fill nozzle mounted tank identification reader assembly including a conduit portion connected in series with the nozzle and electronic circuitry mounted exteriorly of the conduit portion.

Further in accordance with a preferred embodiment of the present invention the conduit portion is removably connected in series with the nozzle.

Additionally in accordance with a preferred embodiment of the present invention the conduit portion is threadably connected in series with the nozzle.

Still further in accordance with a preferred embodiment of the present invention the electronic circuitry is removably mounted onto the conduit portion.

Moreover in accordance with a preferred embodiment of the present invention the electronic circuitry includes at least one battery which is removably mounted onto the conduit portion. Additionally or alternatively the electronic circuitry is removably mounted onto said conduit portion and includes a switch which prevents electrical arcing upon mounting or removal of the electronic circuitry from said conduit portion.

Furthermore in accordance with a preferred embodiment of the present invention the electronic circuitry is removably mounted onto the conduit portion and includes a switch which prevents electrical arcing upon mounting or removal of the at least one battery.

Preferably the electronic circuitry is powered by electrical energy stored in an electrical energy storage device associated therewith, and the electrical energy storage device may receive electrical energy from an external electrical energy source.

Additionally in accordance with a preferred embodiment of the present invention the external electrical energy source is associated with the tank identifier.

Still further in accordance with a preferred embodiment of the present invention the external electrical energy source is associated with the controller.

Additionally or alternatively the external electrical energy source is associated with a storage location at which said nozzle is located when not engaged in fluid supply.

Preferably the electrical energy storage device receives electrical energy from an external electrical energy source in a wireless manner.

Furthermore in accordance with a preferred embodiment of the present invention the electrical circuitry is operative in a quiescent mode and in an active mode and wherein the electric circuitry shifts from said quiescent mode to the active mode in response to the orientation of the nozzle.

Additionally in accordance with a preferred embodiment of the present invention the electrical circuitry is coupled to at least one external antenna which is mounted on the nozzle at a location forward of the conduit portion.

Preferably the electrical circuitry is coupled to the at least one external antenna in a wireless manner.

BRIEF DESCRIPTION OF THE DRAWINGS

The present invention will be understood and appreciated more fully from the following detailed description, taken in conjunction with the drawings in which:

FIGS. 5A & 5B are simplified illustrations of one embodiment of a break-before-make power switch arrangement for a component of the computerized fluid supply system constructed and operative in accordance with a preferred embodiment of the present invention.

DETAILED DESCRIPTION OF PREFERRED EMBODIMENTS

The present invention provides a computerized fluid supply system including a controller controlling supply of a fluid via a fluid fill nozzle to a tank, a fluid tank mounted identifier and a fluid fill nozzle mounted tank identification reader assembly. Preferably, the fluid fill nozzle reader is in wireless communication with the tank identifier for receiving tank identification information therefrom and with the system controller.

Reference is now made to FIGS. 1A–1E, which are simplified illustrations of five embodiments of a fluid supply nozzle assembly constructed and operative in accordance with the present invention.

Figure 1A:
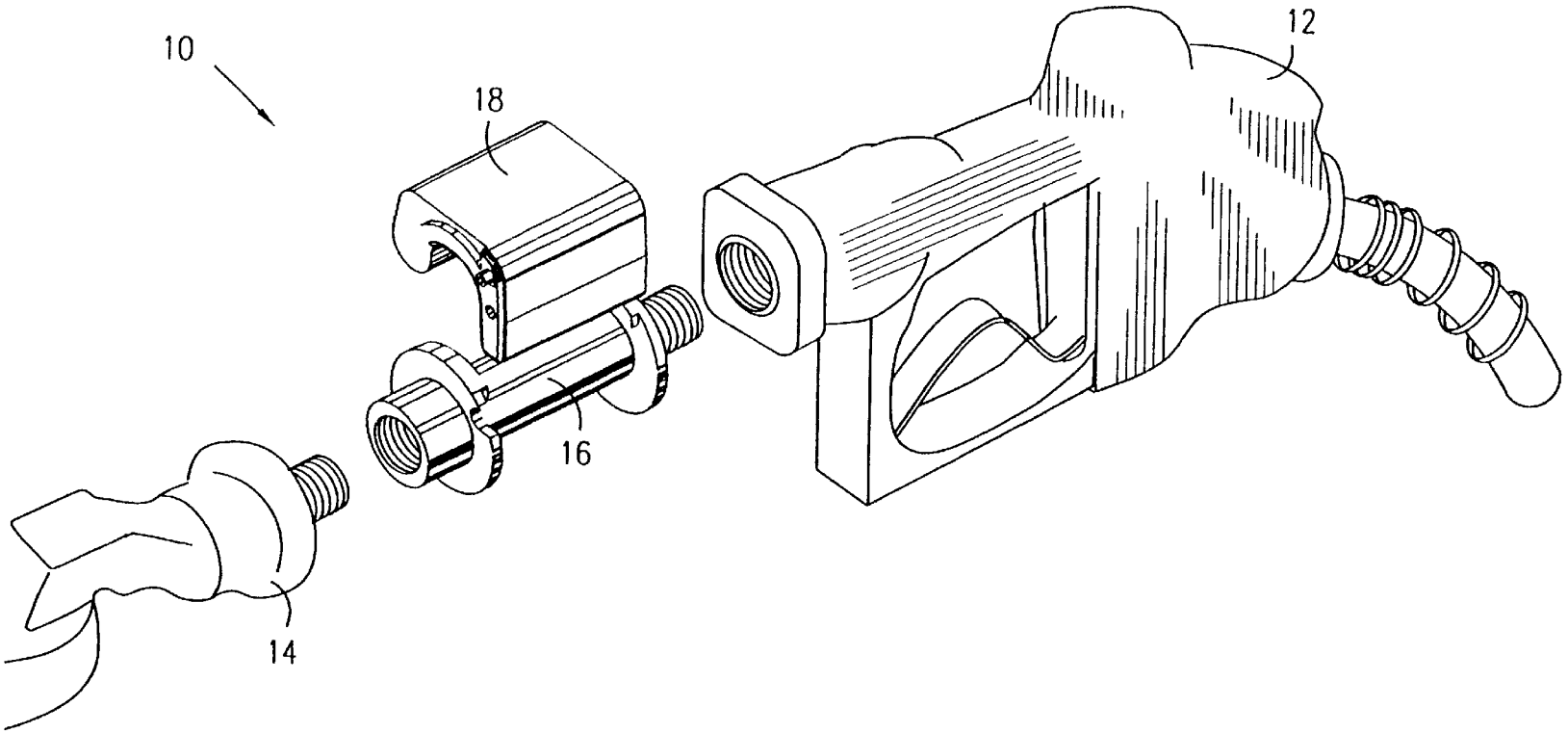
FIGS. 1A–1E are simplified illustrations of five embodiments of a fluid supply nozzle assembly constructed and operative in accordance with the present invention.

As seen in FIG. 1A, there is provided a fluid fill nozzle mounted tank identification reader assembly generally indicated by reference numeral 10, which is mounted intermediate a conventional fluid supply nozzle 12 conventionally employed in vehicle filling stations and a conventional fluid supply hose fitting 14.

Assembly 10 preferably includes a fluid conduit portion 16 which provides fluid communication between hose fitting 14 and nozzle 12 and, removably mounted thereon, a fluid fill nozzle reader 18, including electronic circuitry, which is mounted exteriorly of the conduit portion 16.

Figure 1B:
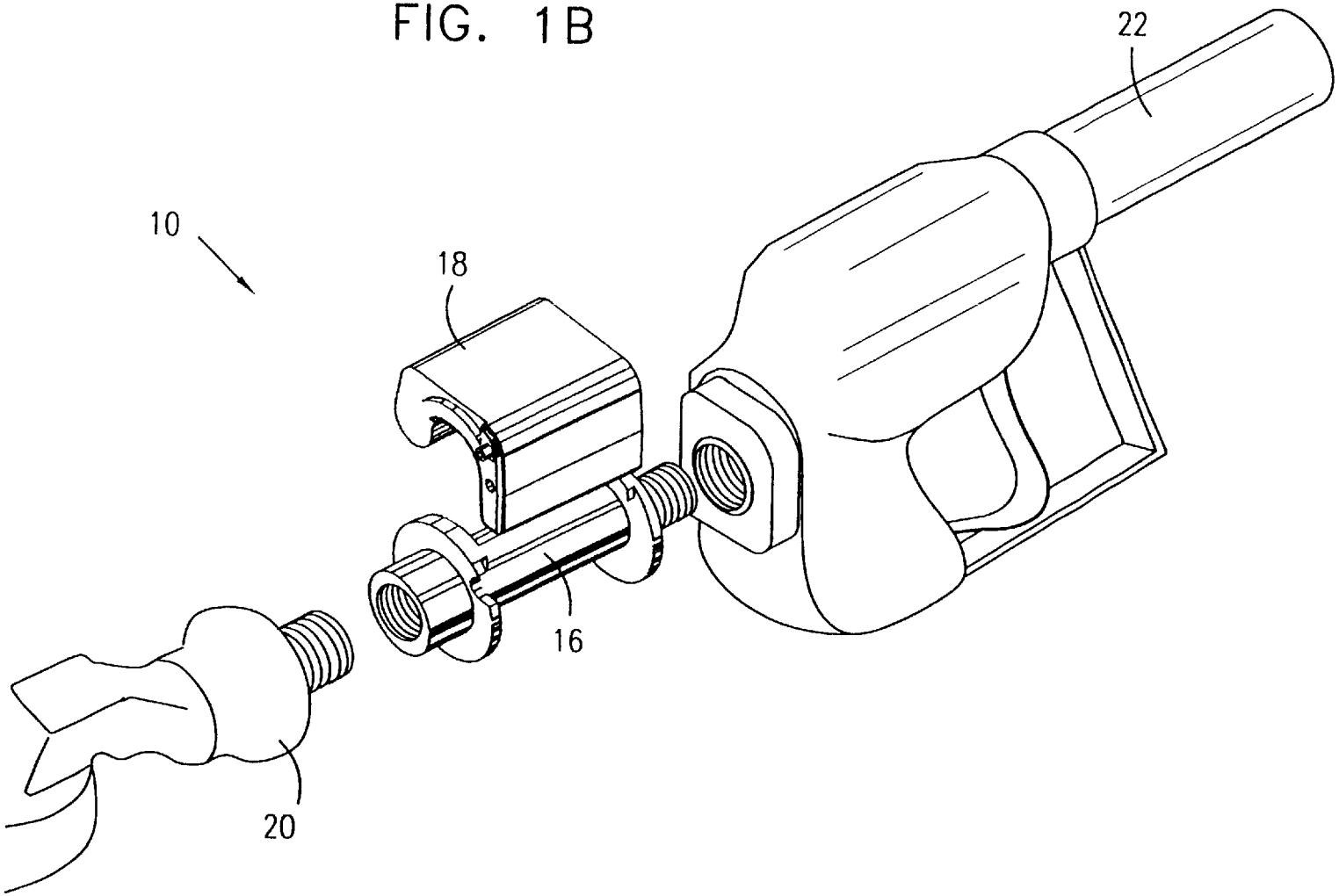

FIG. 1B illustrates assembly 10 mounted intermediate a supply hose 20 and nozzle 22, of the type used for supplying fuel oil.

Figure 1C:
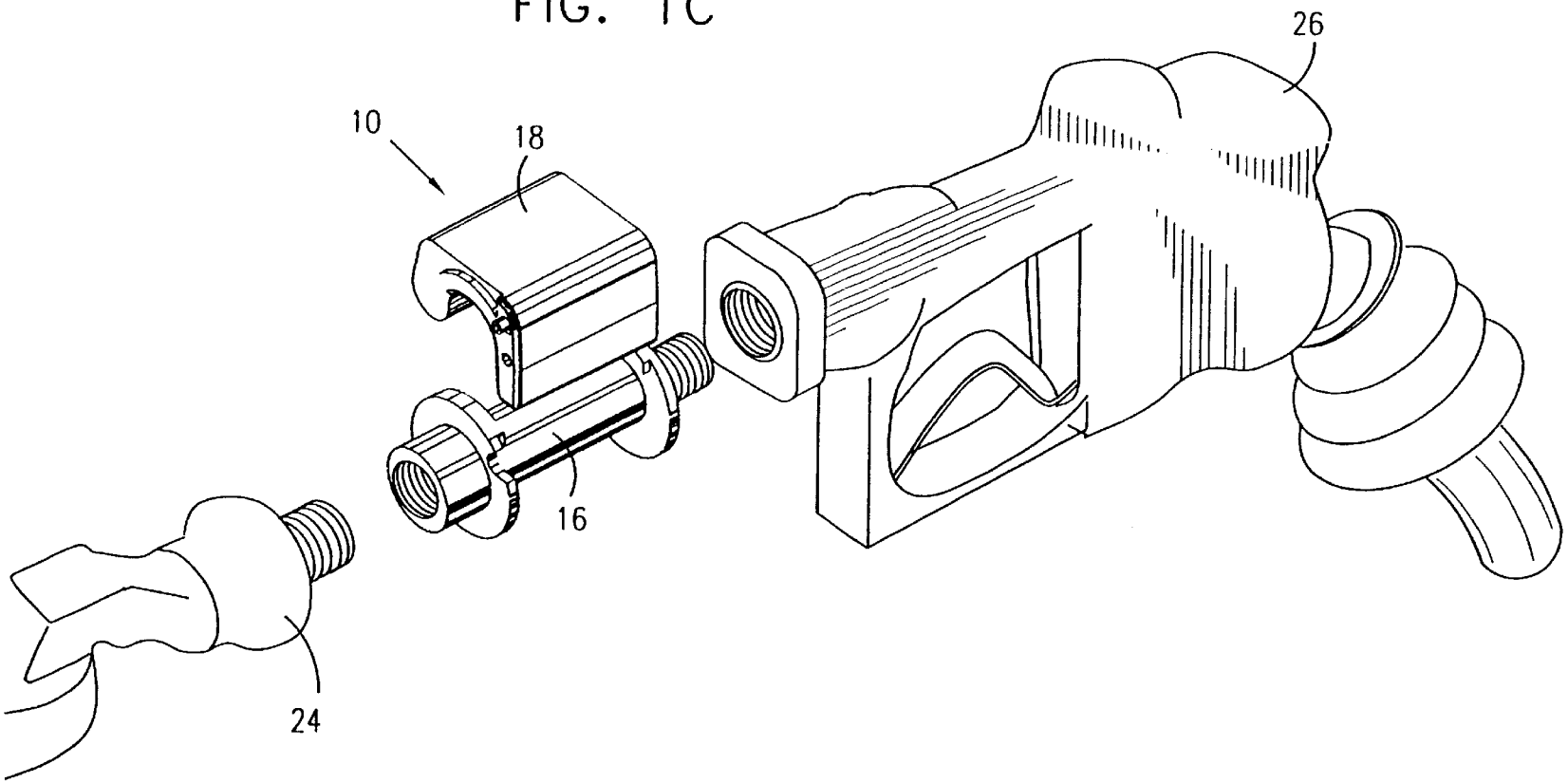

FIG. 1C illustrates assembly 10 mounted intermediate a supply hose 24 and nozzle 26, of another type used for supplying fuel to vehicles.

Figure 1D:
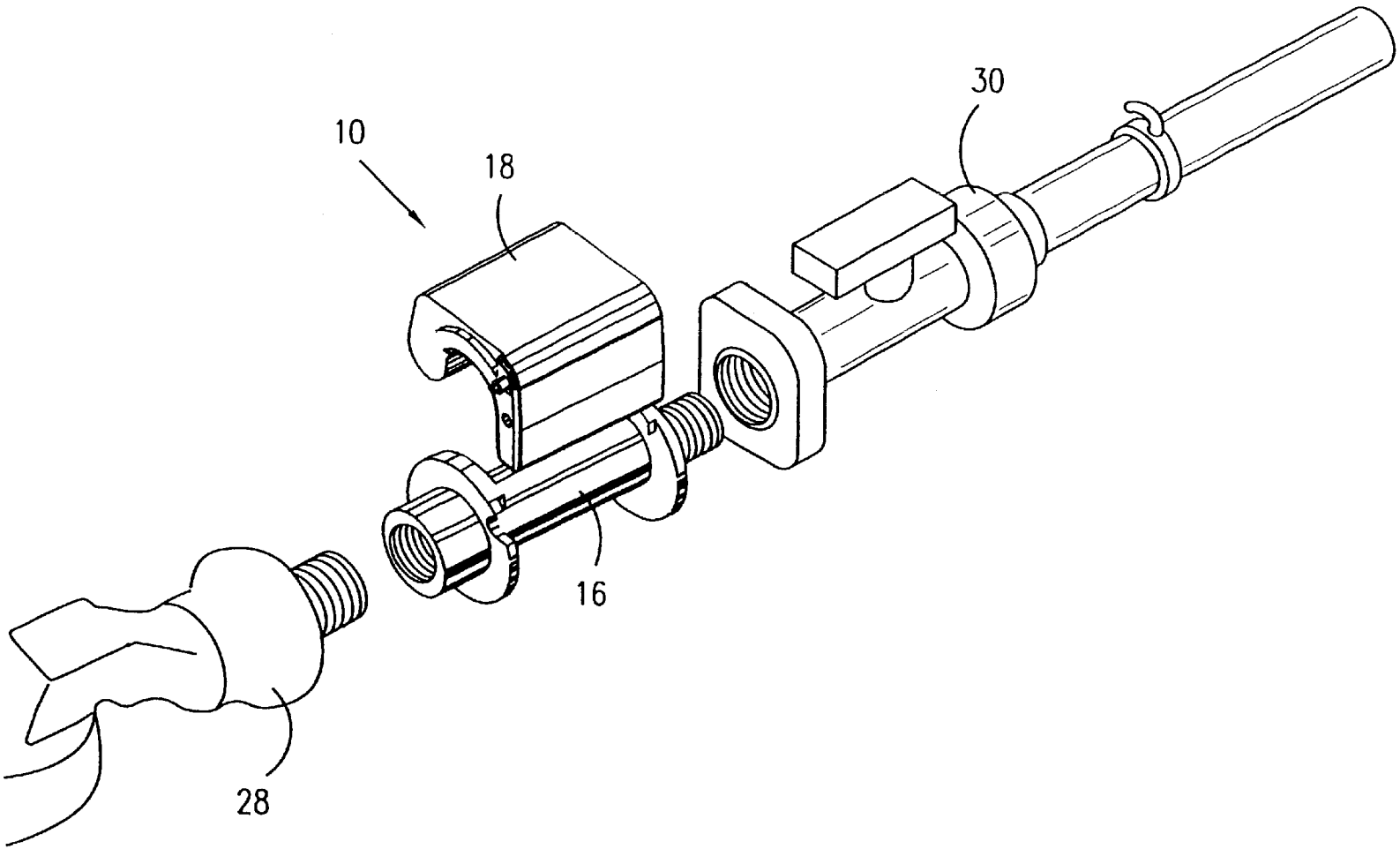

FIG. 1D illustrates assembly 10 mounted intermediate a supply hose 28 and nozzle 30, of the type used for supplying liquefied gas.

Figure 1E:
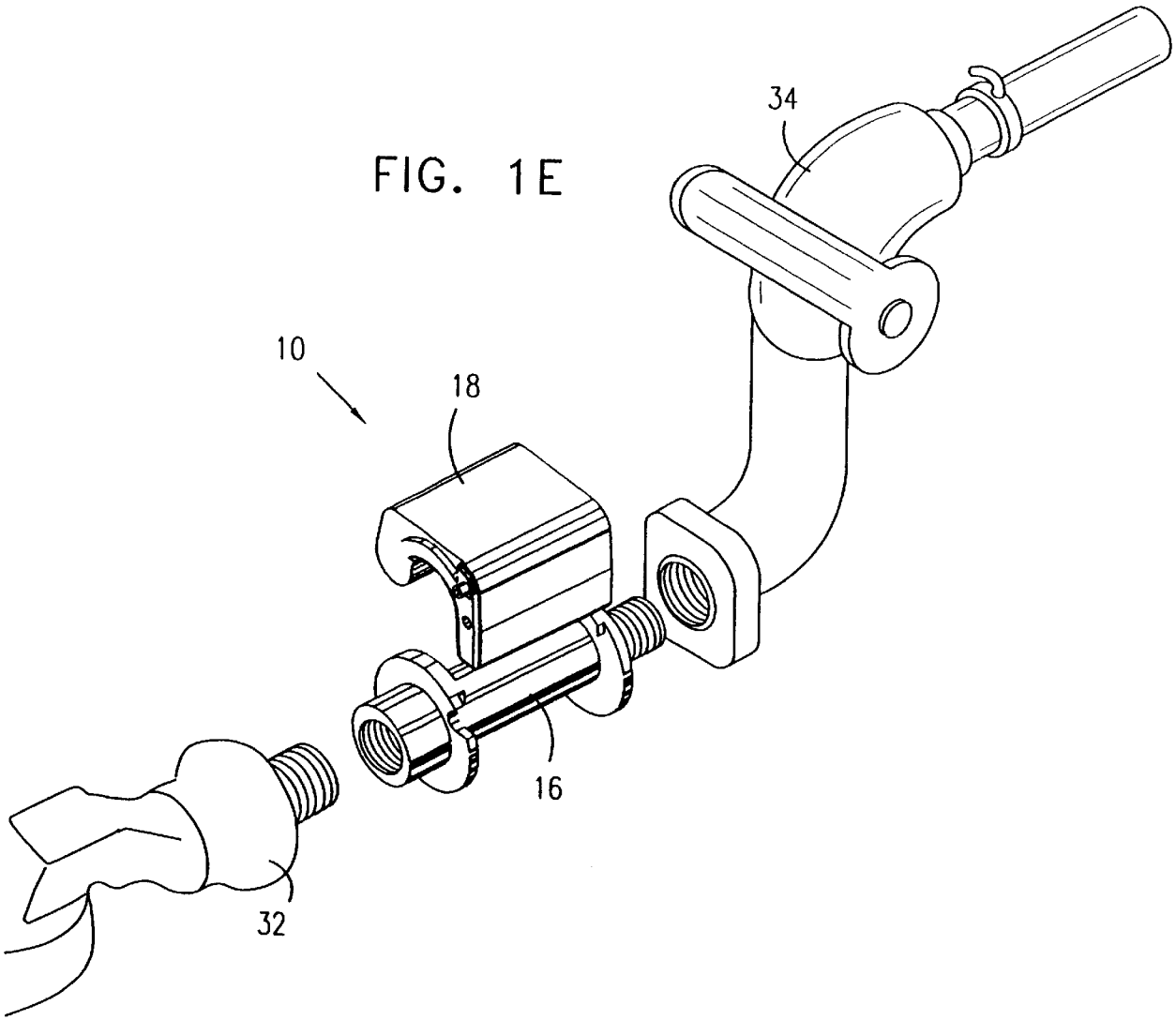

FIG. 1E illustrates assembly 10 mounted intermediate a supply hose 32 and a nozzle 34 of another type used for supplying liquefied gas.

It is seen from the foregoing examples that assembly 10 may be a universal fluid fill nozzle mounted tank identification reader assembly which may be used with a wide variety of nozzles used for various purposes.

Reference is now made to FIGS. 2A–2E, which are simplified illustrations of portions of five embodiments of power supply to assembly 10 in accordance with the present invention.

Figure 2A:
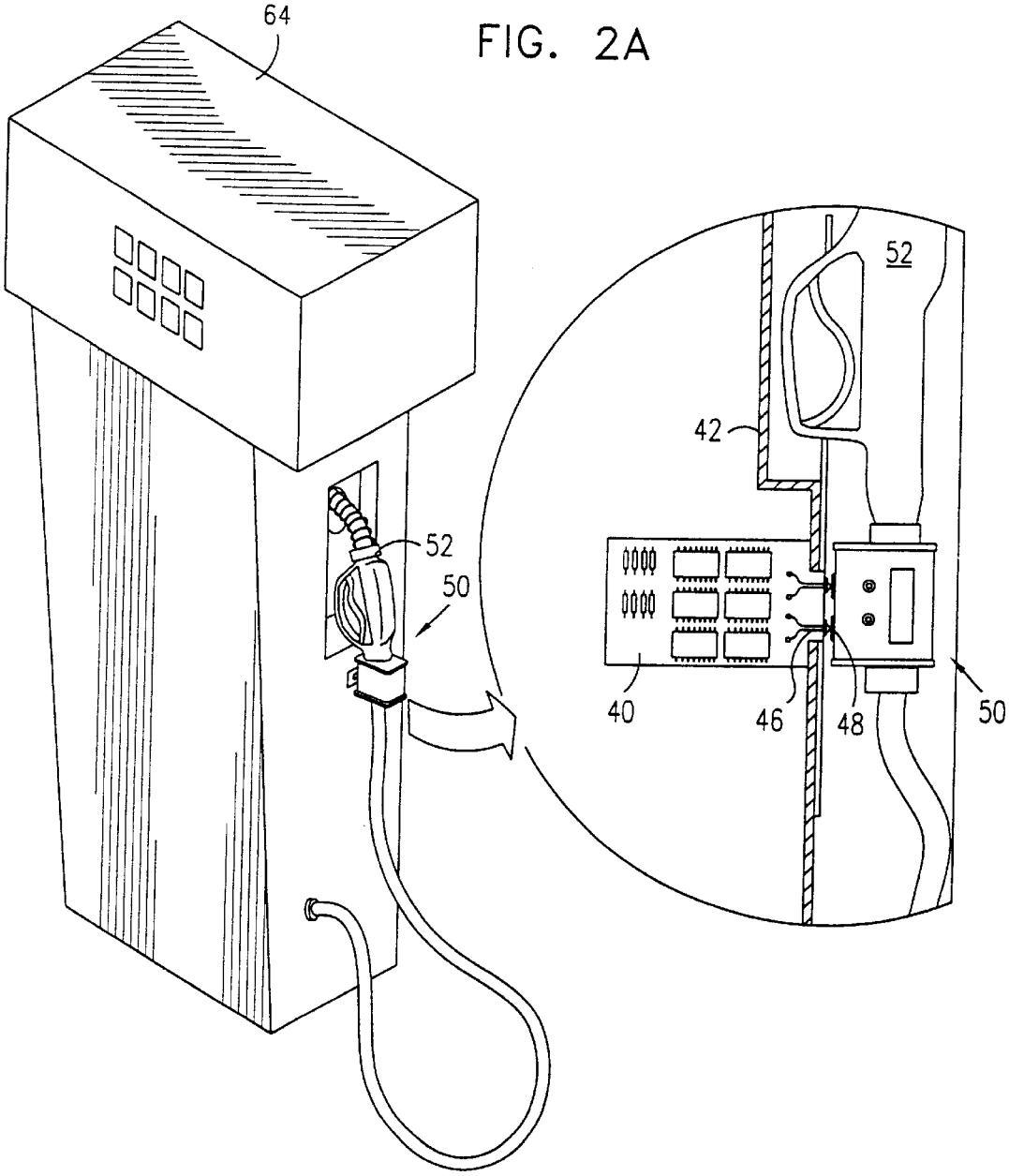
FIGS. 2A–2E are simplified illustrations of portions of five embodiments of power supply to a component of a computerized fluid supply system constructed and operative in accordance with the present invention.

FIG. 2A shows an electrical power supply 40 located within a housing 42 of a conventional vehicle fuel supply pump 64. Electrical power is supplied via electrical contacts 46 to corresponding electrical contacts 48 on a fluid fill nozzle mounted tank identification reader assembly 50, such as assembly 10 (FIGS. 1A–1E), mounted onto a nozzle 52.

Figure 2B:
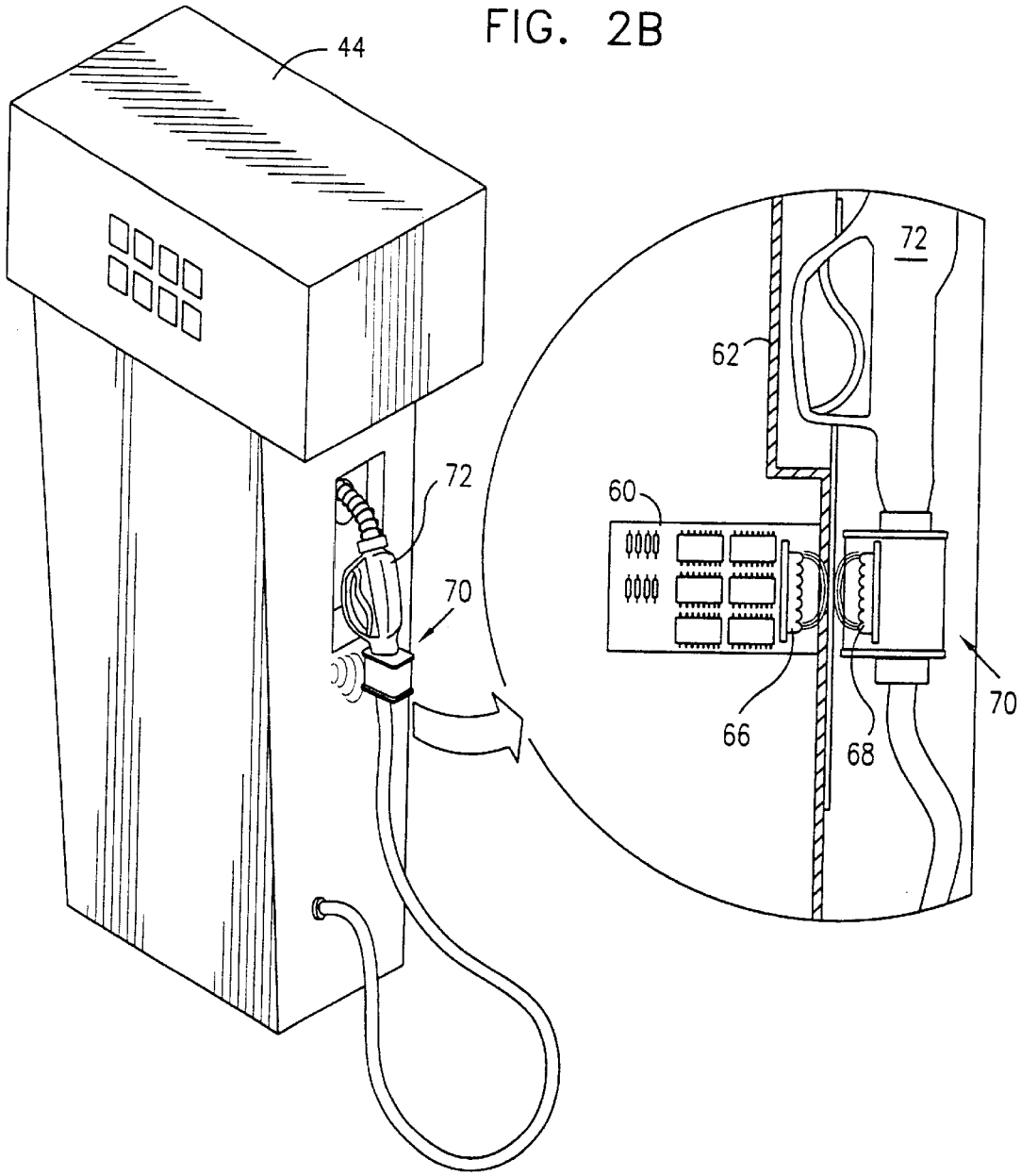

FIG. 2B shows an electrical power supply 60 located within a housing 62 of a conventional vehicle fuel supply pump 44. Electrical power is supplied via an induction coil 66 to a corresponding induction coil 68 on a fluid fill nozzle mounted tank identification reader assembly 70, such as assembly 10 (FIGS. 1A–1E), mounted onto a nozzle 72.

Figure 2C:
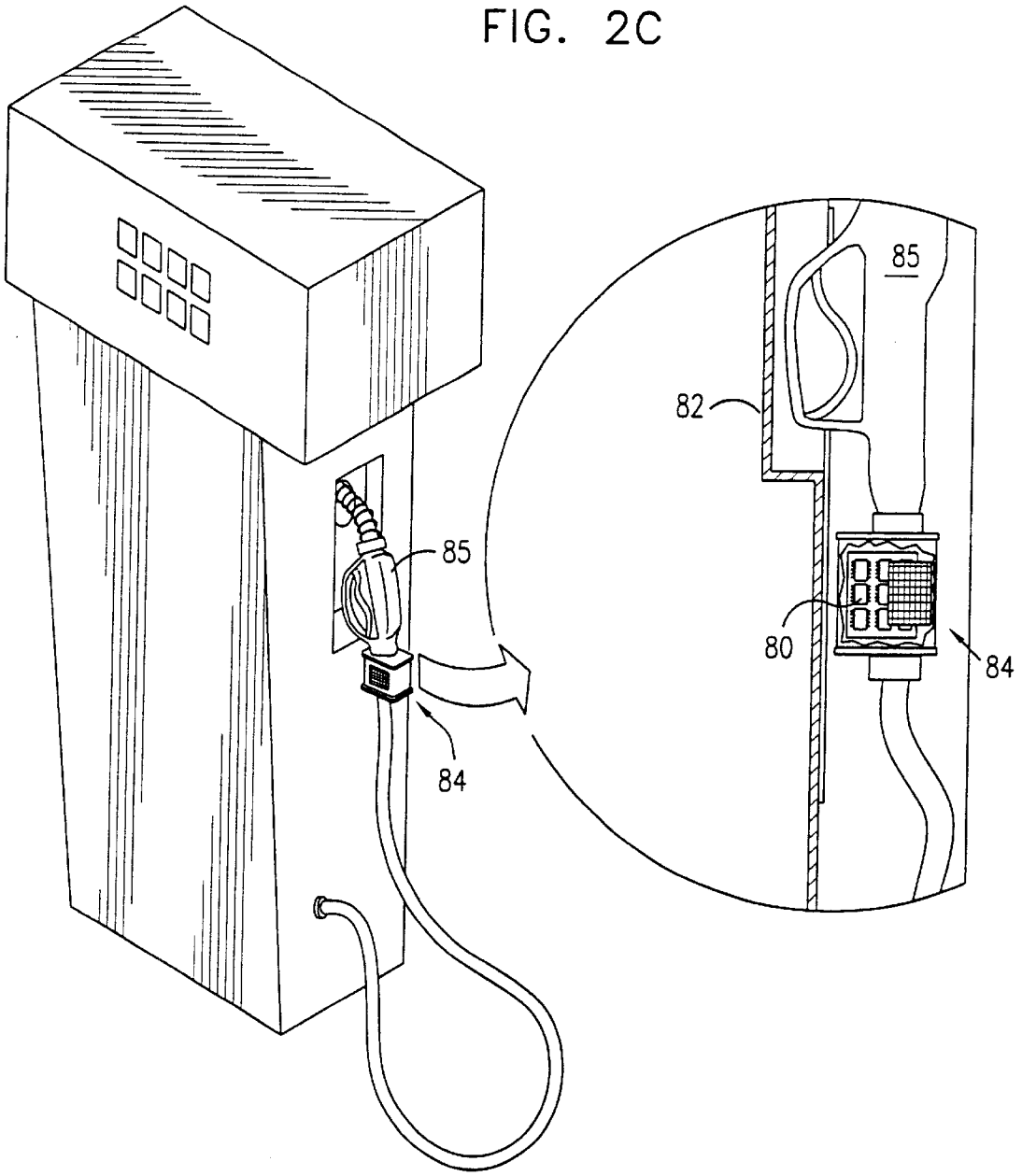

FIG. 2C shows a solar powered electrical power supply 80 located within a housing 82 of a fluid fill nozzle mounted tank identification reader assembly 84, such as assembly 10 (FIGS. 1A–1E), mounted onto a nozzle 85.

Figure 2D:
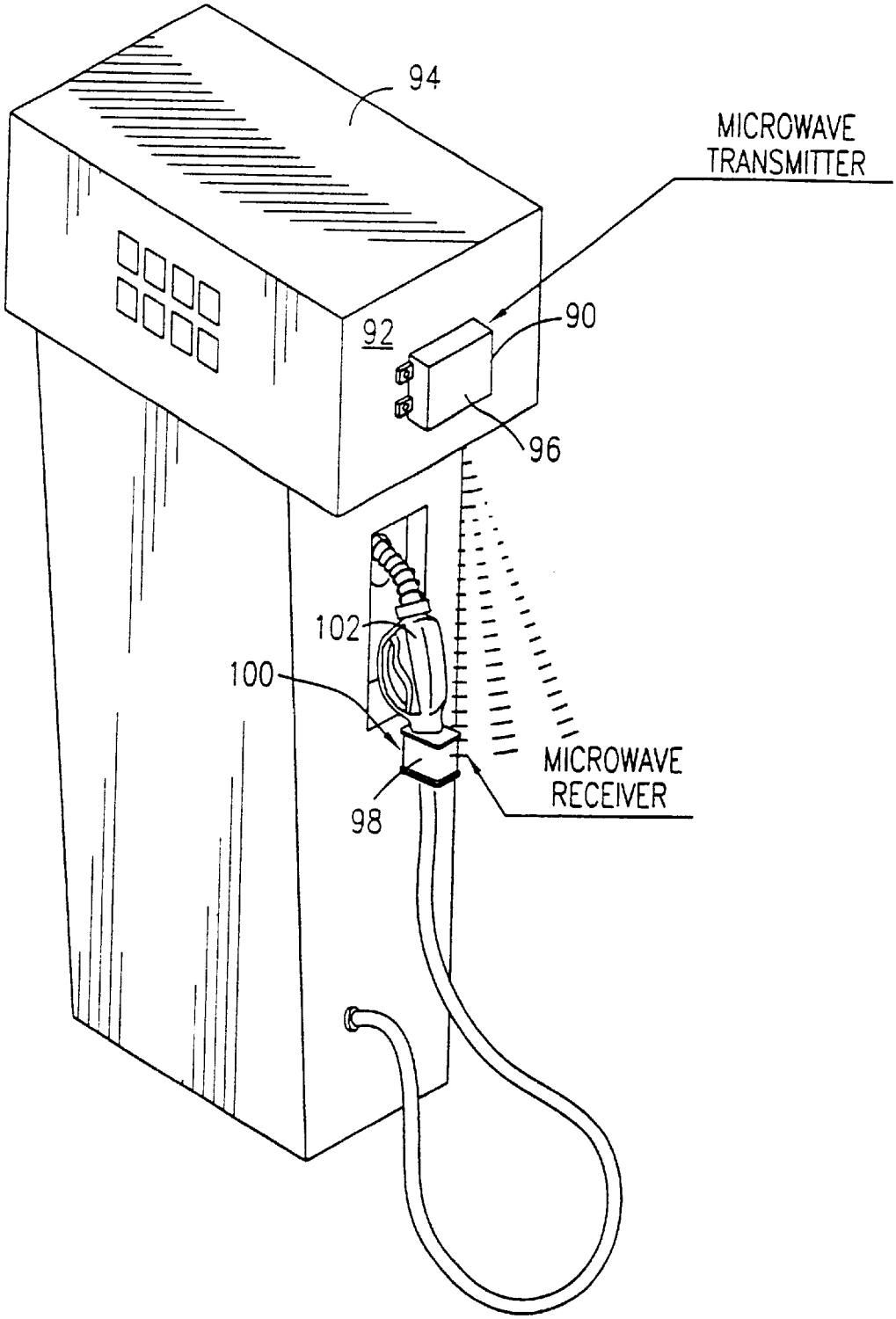

FIG. 2D shows an electrical power supply 90 mounted onto a housing 92 of a conventional vehicle fuel supply pump 94. Electrical power is supplied via a microwave transmitter 96 associated with power supply 90 to a corresponding microwave receiver 98 incorporated in a fluid fill nozzle mounted tank identification reader assembly 100, such as assembly 10 (FIGS. 1A–1E), mounted onto a nozzle 102.

Figure 2E:
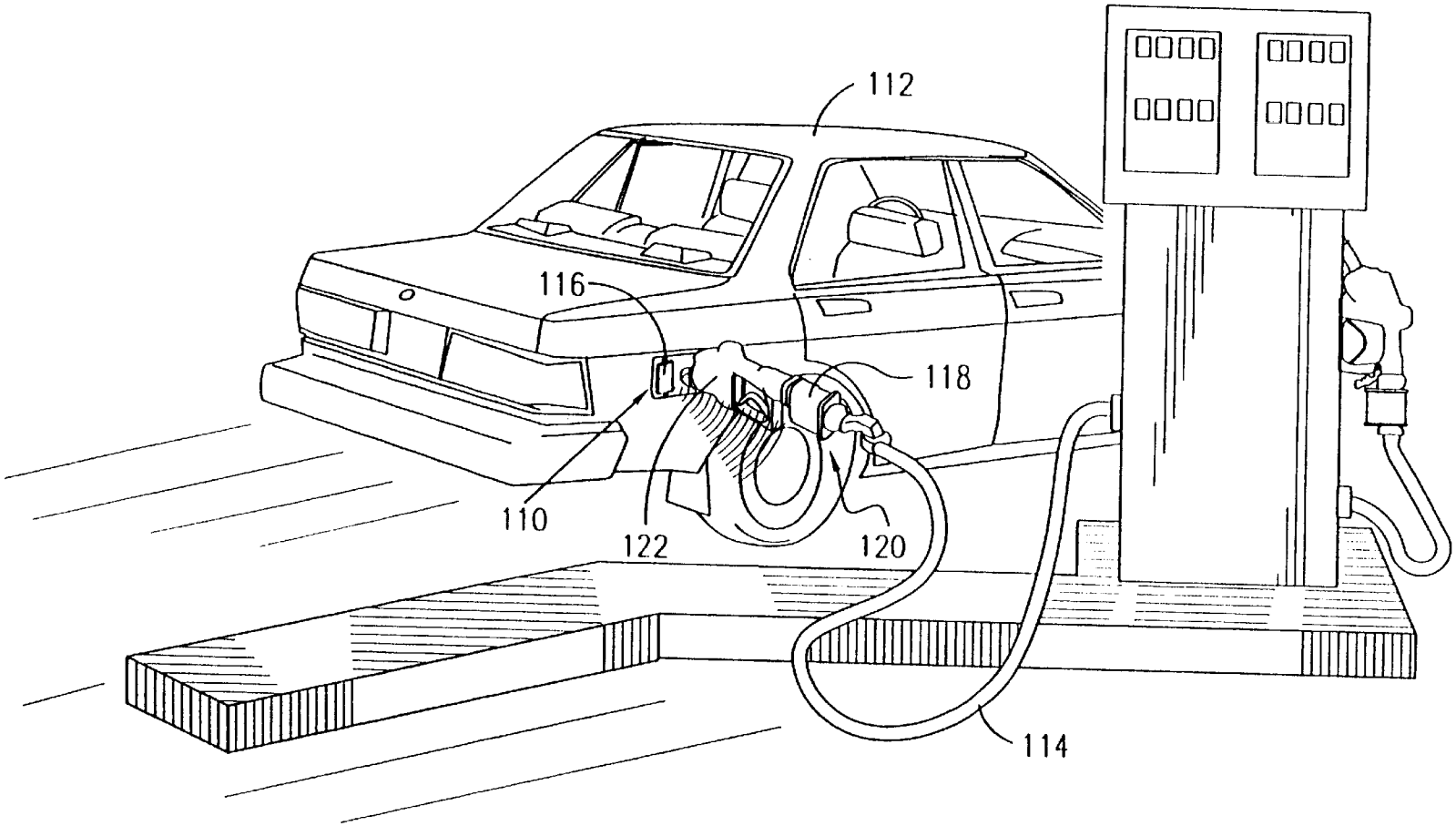

FIG. 2E shows an electrical power supply 110 mounted onto a vehicle 112 adjacent the fuel fill pipe 114 thereof. Electrical power is supplied via an induction coil 116 associated with power supply 110 to a corresponding induction coil 118 on a fluid fill nozzle mounted tank identification reader assembly 120, such as assembly 10 (FIGS. 1A–1E), mounted onto a nozzle 122. As an additional alternative, the embodiments of FIGS. 2D and 2E may be combined, wherein a microwave transmitter may be mounted on a vehicle, such as at a location adjacent the fuel fill pipe thereof.

It is appreciated that as a further alternative, batteries of either the single use or rechargeable type may be employed to provide electrical power.

Figure 3A:
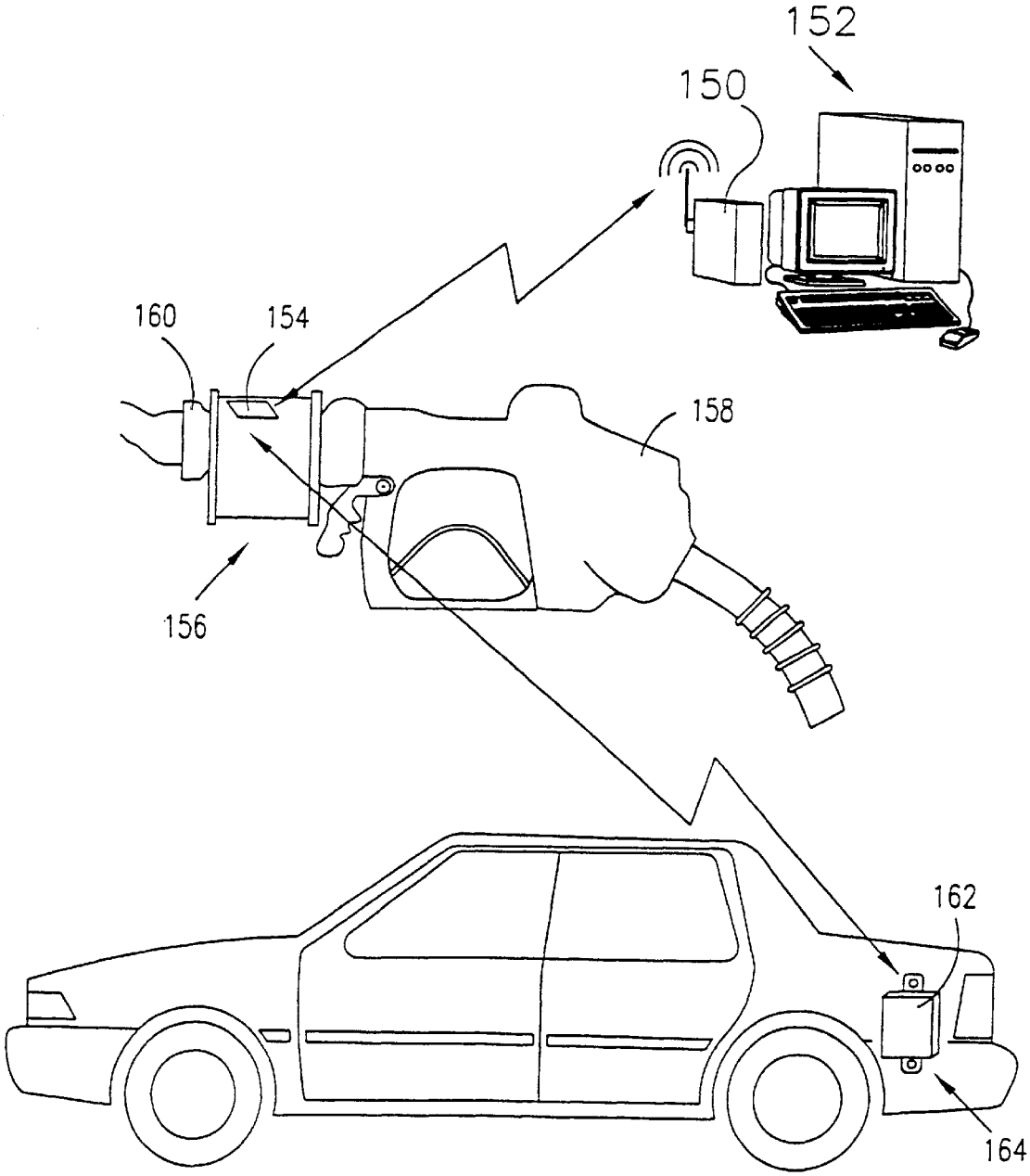
FIGS. 3A & 3B are simplified illustrations of two embodiments of data communication with a component of a computerized fluid supply system constructed and operative in accordance with the present invention.
Figure 3B:
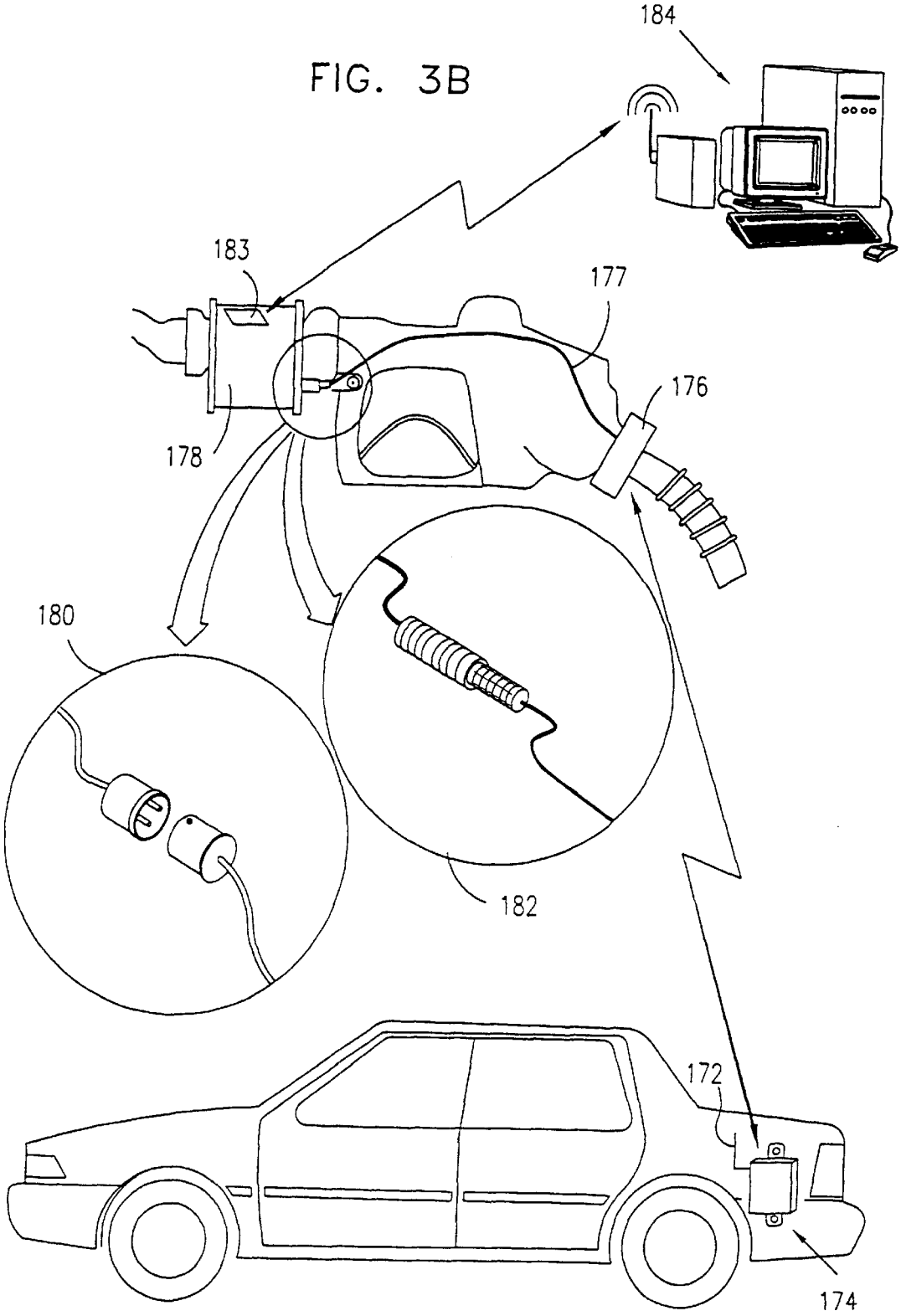

Reference is now made to FIGS. 3A & 3B, which are simplified illustrations of two alternative embodiments of data communication with a component of a computerized fluid supply system constructed and operative in accordance with the present invention. FIG. 3A illustrates wireless data communication taking place between a wireless transceiver 150 at a control station 152 and an antenna 154, which is associated with a wireless transceiver (not shown), and located on a fluid fill nozzle mounted tank identification reader assembly generally indicated by reference numeral 156, which is mounted intermediate a conventional fluid supply nozzle 158 conventionally employed in vehicle filling stations and a conventional fluid supply hose fitting 160. FIG. 3A also illustrates wireless data communication taking place between the fluid nozzle mounted tank identification assembly 156 and a wireless transceiver 162 associated with a fluid tank mounted identifier 164. It is appreciated that wireless transceiver 162 may also be an integral part of identifier 1614.

FIG. 3B shows an arrangement similar to that of FIG. 3A wherein an antenna 172 associated with a fluid tank mounted identifier 174 communicates with a nozzle mounted antenna 176 which is connected via a wired connection 177 to a fluid fill nozzle mounted tank identification reader assembly generally indicated by reference numeral 178. The wired connection 177 may employ a conventional pin connector 180, an inductive connector 182 or any other suitable connector. It is appreciated that wired connection 177 may be replaced by a continuous wire without an intermediate connector. In the embodiment of FIG. 3B, as distinct from that of FIG. 3A, separate antennae 183 and 176 at the fluid fill nozzle are employed for communication with a control station 184 and with fluid tank mounted identifier 174.

Figure 4A:
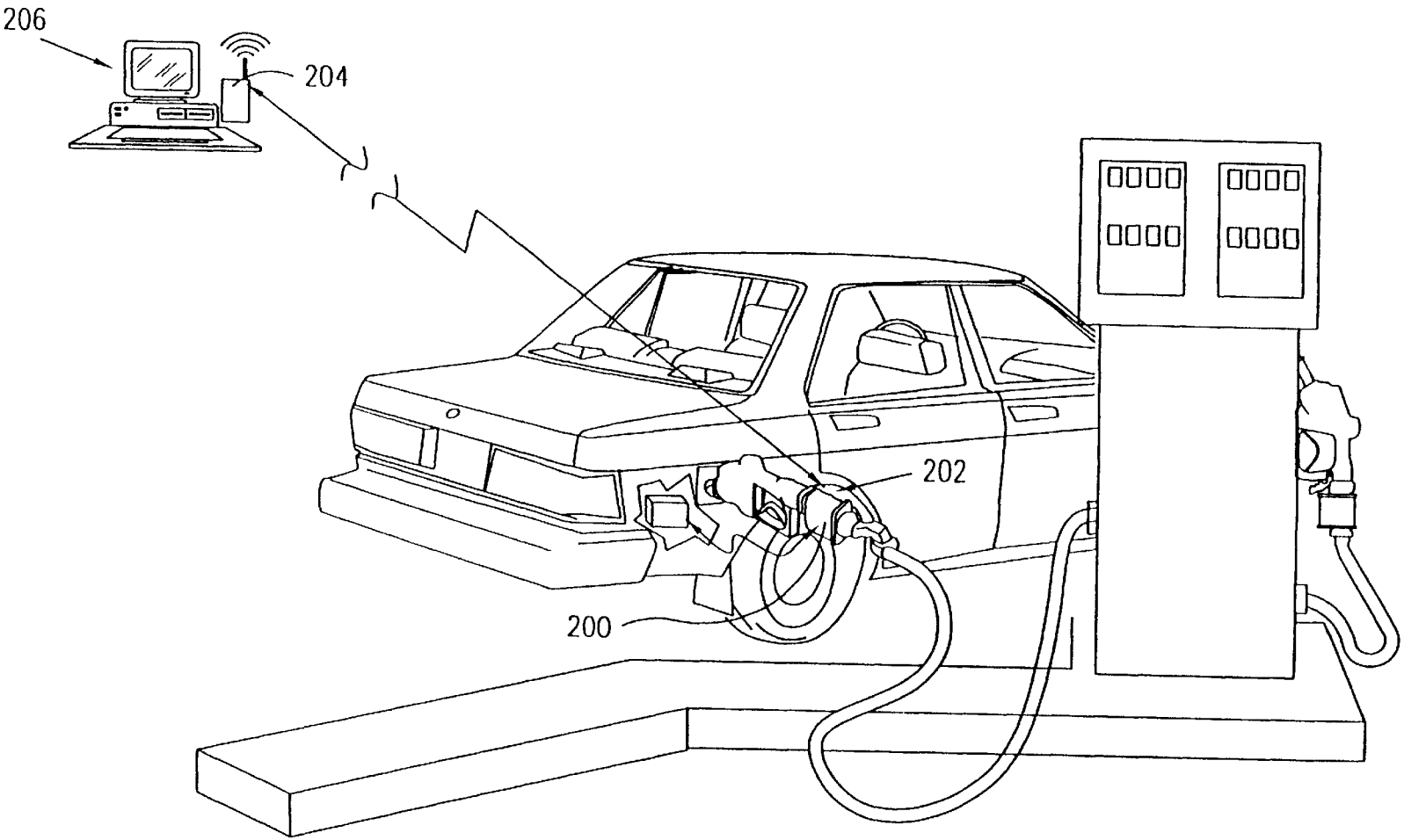
FIGS. 4A & 4B are simplified illustrations of respective stationary and mobile embodiments of a computerized fluid supply system constructed and operative in accordance with a preferred embodiment of the present invention.
Figure 4B:
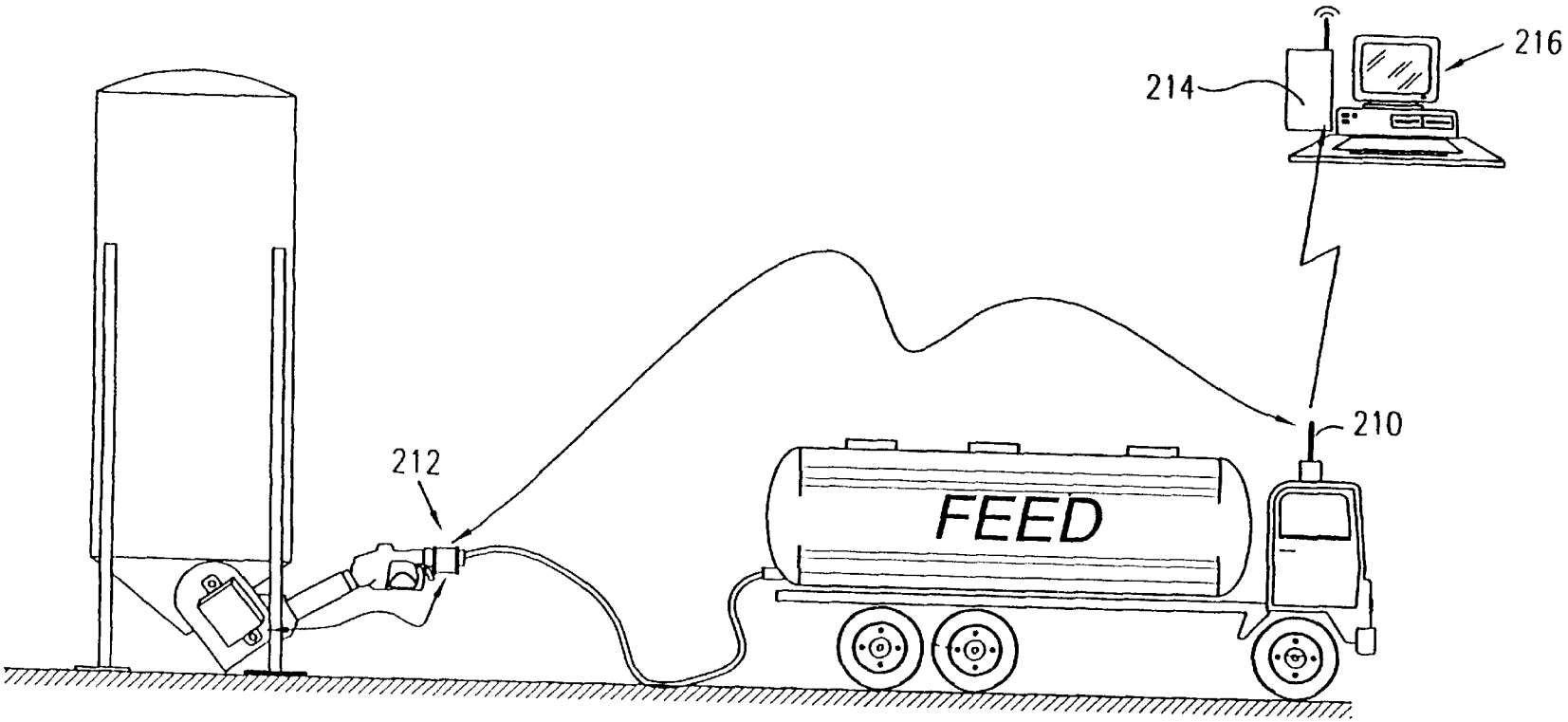

Reference is now made to FIGS. 4A & 4B, which are simplified illustrations of respective stationary and mobile embodiments of a computerized fluid supply system constructed and operative in accordance with a preferred embodiment of the present invention. FIG. 4A shows a stationary embodiment wherein data communication takes place between a generally stationary wireless transceiver 200 which is associated with a fluid fill nozzle mounted tank identification reader assembly generally indicated by reference numeral 202 and a corresponding wireless transceiver 204, associated with a control station 206, typically located at the same premises as assembly 202.

In contrast, FIG. 4B illustrates a situation wherein data communication takes place between a mobile wireless transceiver 210 which is associated with a vehicle mounted fluid fill nozzle mounted tank identification reader assembly generally indicated by reference numeral 212 and a corresponding wireless transceiver 214, associated with a control station 216, typically located remote from vehicle mounted assembly 212.

Reference is now made to FIGS. 5A & 5B, which are simplified illustrations of one embodiment of a break-before-make power switch arrangement for supply of electrical power to reader 18 of assembly 10 (FIGS. 1A–1E) in accordance with a preferred embodiment of the present invention. A spring loaded switch actuator 250 is mounted onto reader 18. When reader 18 is not mounted onto conduit portion 16, actuator 250 is extended, thus breaking the circuit between a supply of electrical power and reader 18, as illustrated in FIG. 5A. When reader 18 is mounted onto conduit portion 16, as shown in FIG. 5B, actuator 250 is retracted, thus closing the circuit.

Figure 6A:
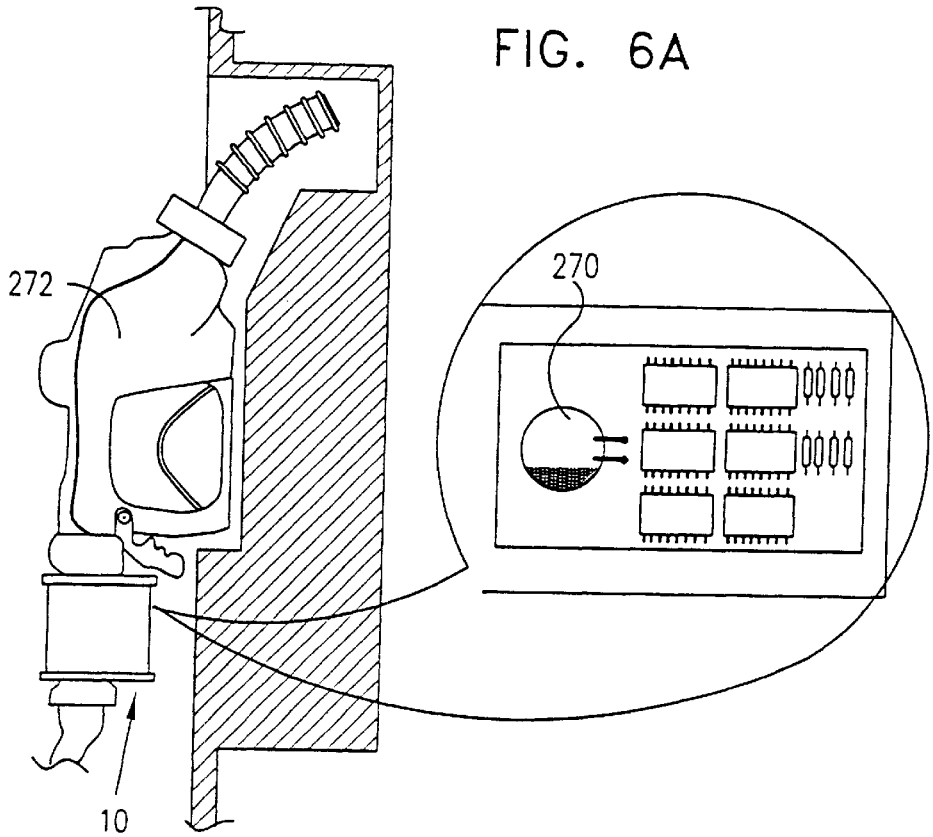
FIGS. 6A & 6B are simplified illustrations of an embodiment of a switch arrangement for a component of the computerized fluid supply system constructed and operative in accordance with a preferred embodiment of the present invention.
Figure 6B:
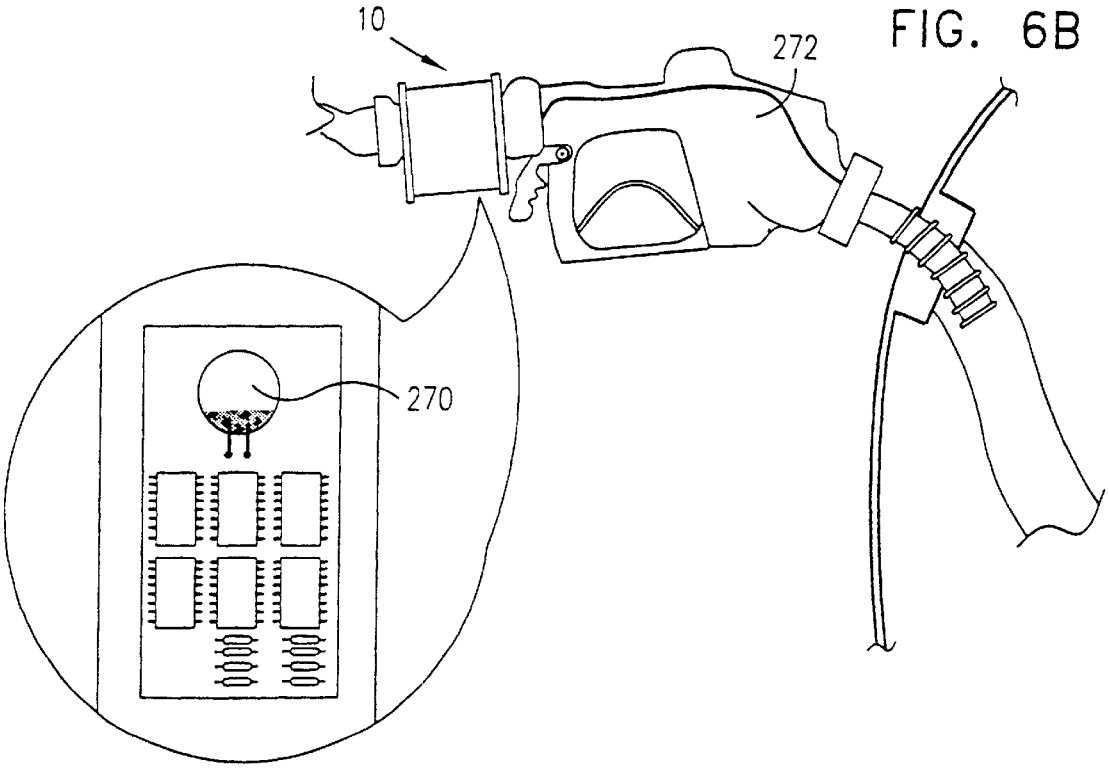

Reference is now made to FIGS. 6A & 6B, which are simplified illustrations of an embodiment of a switch arrangement for a component of the computerized fluid supply system constructed and operative in accordance with a preferred embodiment of the present invention. In this embodiment, a tilt switch 270 is provided, opening a circuit when a nozzle 272 onto which assembly 10 (FIGS. 1A–1E) is mounted is in a storage orientation, as shown in FIG. 6A, and closing a circuit when nozzle 272 is in an operative orientation, as shown in FIG. 6B.

It will be appreciated by persons skilled in the art that the present invention is not limited to what has been particularly shown and described hereinabove. Rather the scope of the present invention includes both combinations and subcombinations of various features described hereinabove as well as modifications and variations thereof which would occur to persons skilled in the art upon reading the foregoing description and which are not in the prior art.

What is claimed is:

1. A computerized fluid supply system comprising:

a controller controlling at least supply of a fluid via a fluid fill nozzle to a tank;

a fluid tank mounted identifier, a fluid fill nozzle mounted tank identification reader assembly, said fluid fill nozzle reader assembly being in wireless communication with said tank identifier for receiving tank identification information there from and with said system controller, said fluid fill nozzle mounted tank identification reader assembly including a conduit portion connected in series with said nozzle and electronic circuitry mounted onto said conduit portion exteriorly of said conduit portion.

2. A computerized fluid supply system according to claim 1 and wherein said conduit portion is removably connected in series with said nozzle.

3. A computerized fluid supply system according to claim 1 and wherein said conduit portion is threadably connected in series with said nozzle.

4. A computerized fluid supply system according to claim 1 and wherein said electronic circuitry is removably mounted onto said conduit portion.

5. A computerized fluid supply system according to claim 1 and wherein said electronic circuitry includes at least one battery which is removably mounted onto said conduit portion.

6. A computerized fluid supply system according to claim 1 and wherein said electronic circuitry is powered by electrical energy stored in an electrical energy storage device associated therewith.

7. A computerized fluid supply system according to claim 6 and wherein said electrical energy storage device receives electrical energy from an external electrical energy source.

8. A computerized fluid supply system according to claim 7 and wherein said external energy source is associated with said fluid tank mounted identifier.

9. A computerized fluid supply system according to claim 7 and wherein said external electrical energy source is associated with said controller.

10. A computerized fluid supply system according to claim 7 and wherein said external electrical energy source is associated with a storage location at which said nozzle is located when not engaged in fluid supply.

11. A computerized fluid supply system according to claim 7 and wherein said electrical energy storage device receives electrical energy from an external electrical energy source in a wireless manner.

12. A fluid fill nozzle assembly according to claim 1 and wherein said electronic circuitry is operative in a quiescent mode and in an active mode and wherein said electronic circuitry shifts from said quiescent mode to said active mode in response to the orientation of said nozzle.

13. A computerized fluid supply system comprising:

a controller controlling at least supply of a fluid via a fluid fill nozzle to a tank;

a fluid tank mounted identifier;

a fluid fill nozzle mounted tank identification reader assembly, said fluid fill nozzle reader assembly being in wireless communication with said tank identifier for receiving tank identification information therefrom and with said system controller, said fluid fill nozzle mounted tank identification reader assembly including a conduit portion connected in series with said nozzle and electronic circuitry mounted exteriorly of said conduit portion, wherein said electronic circuitry is removably mounted onto said conduit portion and includes a switch which prevents electrical arcing upon mounting or removal of the electronic circuitry from said conduit portion.

14. A computerized fluid supply system comprising:

a controller controlling at least supply of a fluid via a fluid fill nozzle to a tank;

a fluid tank mounted identifier;

a fluid fill nozzle mounted tank identification reader assembly, said fluid fill nozzle reader assembly being in wireless communication with said tank identifier for receiving tank identification information therefrom and with said system controller, said fluid fill nozzle mounted tank identification reader assembly including a conduit portion connected in series with said nozzle and electronic circuitry mounted exteriorly of said conduit portion, wherein said electronic circuitry includes at least one battery which is removably mounted onto said conduit portion and wherein said electronic circuitry is removably mounted onto said conduit portion and includes a switch which prevents electrical arcing upon mounting or removal of the electronic circuitry from said conduit portion.

15. A computerized fluid supply system comprising:

a controller controlling at least supply of a fluid via a fluid fill nozzle to a tank;

a fluid tank mounted identifier;

a fluid fill nozzle mounted tank identification reader assembly, said fluid fill nozzle reader assembly being in wireless communication with said tank identifier for receiving tank identification information therefrom and with said system controller, said fluid fill nozzle mounted tank identification reader assembly including a conduit portion connected in series with said nozzle and electronic circuitry mounted exteriorly of said conduit portion, wherein said electronic circuitry is coupled to at least one external antenna which is mounted on said nozzle at a location forward of said conduit portion.

16. A computerized fluid supply system according to claim 15 and wherein said electronic circuitry is coupled to said at least one external antenna in a wireless manner.

17. For use in a computerized fluid supply system including a controller controlling at least supply of a fluid via a fluid fill nozzle to a tank and a tank identifier, a fluid fill nozzle mounted tank identification reader assembly, said fluid flu nozzle reader assembly being in wireless communication with said tank identifier for receiving tank identification information therefrom and with said system controller, said fluid fill nozzle mounted tank identification reader assembly including a conduit portion connected in series with said nozzle and electronic circuitry mounted onto said conduit portion exteriorly of said conduit portion.

18. A fluid fill nozzle mounted tank identification reader assembly according to claim 17 and wherein said conduit portion is removably connected in series with said nozzle.

19. A fluid fill nozzle mounted tank identification reader assembly according to claim 17 and wherein said conduit portion is threadably connected in series with said nozzle.

20. A fluid fill nozzle mounted tank identification reader assembly according to claim 17 and wherein said electronic circuitry is removably mounted onto said conduit portion.

21. A fluid fill nozzle mounted tank identification reader assembly according to claim 17 and wherein said electronic circuitry includes at least one battery which is removably mounted onto said conduit portion.

22. A fluid fill nozzle mounted tank identification reader assembly according to claim 17 and wherein said electronic circuitry is powered by electrical energy stored in an electrical energy storage device associated therewith.

23. A fluid fill nozzle mounted tank identification reader assembly according to claim 22 and wherein said electrical energy storage device receives electrical energy from an external electrical energy source.

24. A computerized fluid supply system according to claim 23 and wherein said external energy source is associated with said fluid tank mounted identifier.

25. A fluid fill nozzle mounted tank identification reader assembly according to claim 23 and wherein said external electrical energy source is associated with said controller.

26. A fluid fill nozzle mounted tank identification reader assembly according to claim 23 and wherein said external electrical energy source is associated with a storage location at which said nozzle is located when not engaged in fluid supply.

27. A fluid fill nozzle mounted tank identification reader assembly according to claim 23 and wherein said electrical energy storage device receives electrical energy from an external electrical energy source in a wireless manner.

28. A fluid fill nozzle assembly according to claim 17 and wherein said electronic circuitry is operative in a quiescent mode and in an active mode and wherein said electronic circuitry shifts from said quiescent mode to said active mode in response to the orientation of said nozzle.

29. For use in a computerized fluid supply system including a controller controlling at least supply of a fluid via a fluid fill nozzle to a tank and a tank identifier, a fluid fill nozzle mounted tank identification reader assembly, said fluid fill nozzle reader assembly being in wireless communication with said tank identifier for receiving tank identification information therefrom and with said system controller, said fluid fill nozzle mounted tank identification reader assembly including a conduit portion connected in series with said nozzle and electronic circuitry mounted exteriorly of said conduit portion wherein said electronic circuitry is removably mounted onto said conduit portion and includes a switch which prevents electrical arcing upon mounting or removal of the electronic circuitry from said conduit portion.

30. For use in a computerized fluid supply system including a controller controlling at least supply of a fluid via a fluid fill nozzle to a tank and a tank identifier, a fluid fill nozzle mounted tank identification reader assembly, said fluid fill nozzle reader assembly being in wireless communication with said tank identifier for receiving tank identification information therefrom and with said system controller, said fluid fill nozzle mounted tank identification reader assembly including a conduit portion connected in series with said nozzle and electronic circuitry mounted exteriorly of said conduit portion wherein said electronic circuitry includes at least one battery which is removably mounted onto said conduit portion and said electronic circuitry is removably mounted onto said conduit portion and includes a switch which prevents electrical arcing upon mounting or removal of the at least one battery.

31. A fluid fill nozzle mounted tank identification reader assembly for use in a computerized fluid supply system including a controller controlling at least supply of a fluid via a fluid fill nozzle to a tank and a tank identifier, said fluid fill nozzle reader assembly being in wireless communication with said tank identifier for receiving tank identification information therefrom and with said system controller, said fluid fill nozzle mounted tank identification reader assembly including a conduit portion connected in series with said nozzle and electronic circuitry mounted exteriorly of said conduit portion, and wherein said electronic circuitry is coupled to at least one external antenna which is mounted on said nozzle at a location forward of said conduit portion.

32. A fluid fill nozzle mounted tank identification reader assembly according to claim 31 and wherein said electronic circuitry is coupled to said at least one external antenna in a wireless manner.

33. For use in a computerized fluid supply system including a controller controlling at least supply of fluid via a fluid fill nozzle to a fluid receiving tank d a tank identifier, a fluid fill nozzle assembly including a fluid fill nozzle mounted tank identification reader assembly, said fluid fill nozzle reader assembly being in wireless communication with said tank identifier for receiving tank identification information therefrom and with said system controller, said fluid fill nozzle mounted tank identification reader assembly including a conduit portion connected in series with said nozzle and electronic circuitry mounted onto said conduit portion exteriorly of said conduit portion.

34. A fluid fill nozzle assembly according to claim 33 and wherein said conduit portion is removably connected in series with said nozzle.

35. A fluid fill nozzle assembly according to claim 33 and wherein said conduit portion is threadably connected in series with said nozzle.

36. A fluid fill nozzle assembly according to claim 33 and wherein said electronic circuitry is removably mounted onto said conduit portion.

37. A fluid fill nozzle assembly according to claim 33 and wherein said electronic circuitry includes at least one battery which is removably mounted onto said conduit portion.

38. A fluid fill nozzle assembly according to claim 33 and wherein said electronic circuitry is powered by electrical energy stored in an electrical energy storage device associated therewith.

39. A fluid fill nozzle assembly according to claim 38 and wherein said electrical energy storage device receives electrical energy from an external electrical energy source.

40. A computerized fluid supply system according to claim 39 and wherein said external energy source is associated with said fluid tank mounted identifier.

41. A fluid fill nozzle assembly according to claim 39 and wherein said external electrical energy source is associated with said controller.

42. A fluid fill nozzle assembly according to claim 39 and wherein said external electrical energy source is associated with a storage location at which said nozzle is located when not engaged in fluid supply.

43. A fluid fill nozzle assembly according to claim 39 and wherein said electrical energy storage device receives electrical energy from an external electrical energy source in a wireless manner.

44. A fluid fill nozzle assembly according to claim 33 and wherein said electronic circuitry is operative in a quiescent mode and in an active mode and wherein said electronic circuitry shifts from said quiescent mode to said active mode in response to the orientation of said nozzle.

45. A fluid fill nozzle assembly according to claim 42 and wherein said electronic circuitry is coupled to said at least one external antenna in a wireless manner.

46. For use in a computerized fluid supply system including a controller controlling at least supply of fluid via a fluid fill nozzle to a fluid receiving tank and a tank identifier, a fluid fill nozzle assembly including a fluid fill nozzle mounted tank identification reader assembly, said fluid fill nozzle reader assembly being in wireless communication with said tank identifier for receiving tank identification information therefrom and with said system controller, said fluid fill nozzle mounted tank identification reader assembly including a conduit portion connected in series with said nozzle and electronic circuitry mounted exteriorly of said conduit portion, and wherein said electronic circuitry is removably mounted onto said conduit portion and includes a switch which prevents electrical arcing upon mounting or removal of the electronic circuitry from said conduit portion.

47. For use in a computerized fluid supply system including a controller controlling at least supply of fluid via a fluid fill nozzle to a fluid receiving tank and a tank identifier, a fluid fill nozzle assembly including a fluid fill nozzle mounted tank identification reader assembly, said fluid fill nozzle reader assembly being in wireless communication with said tank identifier for receiving tank identification information therefrom and with said system controller, said fluid fill nozzle mounted tank identification reader assembly including a conduit portion connected in series with said nozzle and electronic circuitry mounted exteriorly of said conduit portion, and wherein said electronic circuitry includes at least one battery which is removably mounted onto said conduit portion and wherein said electronic circuitry is removably mounted onto said conduit portion and includes a switch which prevents electrical arcing upon mounting or removal of the at least one battery.

48. For use in a computerized fluid supply system including a controller controlling at least supply of fluid via a fluid fill nozzle to a fluid receiving tank and a tank identifier, a fluid fill nozzle assembly including a fluid fill nozzle mounted tank identification reader assembly, said fluid fill nozzle reader assembly being in wireless communication with said tank identifier for receiving tail identification information therefrom and with said system controller, said fluid fill nozzle mounted tank identification reader assembly including a conduit portion connected in series with said nozzle and electronic circuitry mounted exteriorly of said conduit potion, and wherein said, electronic circuitry is coupled to said at least one external antenna in a wireless manner.

* * * * *